US011326821B2

(12) United States Patent
Krishnamoorthy et al.

(10) Patent No.: US 11,326,821 B2
(45) Date of Patent: May 10, 2022

(54) $CO_2$ REFRIGERATION SYSTEM WITH HIGH PRESSURE VALVE CONTROL BASED ON COEFFICIENT OF PERFORMANCE

(71) Applicant: Hill Phoenix, Inc., Conyers, GA (US)

(72) Inventors: Naresh Kumar Krishnamoorthy, Karamana (IN); Nassim Khaled, Decatur, GA (US)

(73) Assignee: Hill Phoenix, Inc., Conyers, GA (US)

( * ) Notice: Subject to any disclaimer, the term of this patent is extended or adjusted under 35 U.S.C. 154(b) by 256 days.

(21) Appl. No.: 16/512,880

(22) Filed: Jul. 16, 2019

(65) Prior Publication Data

US 2020/0033039 A1 Jan. 30, 2020

Related U.S. Application Data

(60) Provisional application No. 62/711,056, filed on Jul. 27, 2018.

(51) Int. Cl.

*F25B 49/02* (2006.01)
*F25B 9/00* (2006.01)
*F25B 41/20* (2021.01)

(52) U.S. Cl.

CPC ..... *F25B 49/027* (2013.01); *F25B 9/008* (2013.01); *F25B 41/20* (2021.01); *F25B 2400/22* (2013.01);

(Continued)

(58) Field of Classification Search

CPC .... F25B 49/027; F25B 9/008; F25B 2500/19; F25B 2600/17; F25B 2600/2503; F25B 2600/2513

(Continued)

(56) References Cited

U.S. PATENT DOCUMENTS 8,966,916 B2 * 3/2015 Deaconu ..... F25B 1/10 62/115
2010/0153057 A1 * 6/2010 Bersch ..... F25B 49/005 702/136
2017/0159982 A1 6/2017 West

FOREIGN PATENT DOCUMENTS

DE 10 2007 063 619 A1 12/2008
DE 10 2016 001 096 A1 8/2017

(Continued)

OTHER PUBLICATIONS

EPO Extended Search Report dated Jan. 7, 2020 re Appl. No. 19187207.6-1008, 8 pps.

(Continued)

*Primary Examiner* — Steve S Tanenbaum
(74) *Attorney, Agent, or Firm* — Fish & Richardson P.C.

(57) ABSTRACT

A refrigeration system includes an evaporator within which a refrigerant absorbs heat, a gas cooler/condenser within which the refrigerant rejects heat, a compressor operable to circulate the refrigerant between the evaporator and the gas cooler/condenser, a high pressure valve operable to control a pressure of the refrigerant at an outlet of the gas cooler/condenser, and a controller. The controller is configured to automatically generate a setpoint for a measured or calculated variable of the refrigeration system based on a measured temperature of the refrigerant at the outlet of the gas cooler/condenser. The setpoint is generated using a stored relationship between the measured temperature and a maximum estimated coefficient of performance (COP) that can be achieved at the measured temperature. The controller is configured to operate the high pressure valve to drive the measured or calculated variable toward the setpoint.

21 Claims, 5 Drawing Sheets

Pressure Control Based on Real-Time Estimation of COP

(52) U.S. Cl.
CPC ..... *F25B 2500/19* (2013.01); *F25B 2600/17* (2013.01); *F25B 2600/2503* (2013.01)

(58) Field of Classification Search
USPC ..... 62/228.1
See application file for complete search history.

(56) References Cited

FOREIGN PATENT DOCUMENTS

| | | | | |
|---|---|---|---|---|
| EP | 2 006 614 | A2 | | 12/2008 |
| JP | 2008002706 | A | * | 1/2008 |

OTHER PUBLICATIONS

Office Action in European Appln. No. 19187207.6, dated Feb. 11, 2022, 6 pages.

* cited by examiner

$CO_2$ REFRIGERATION SYSTEM WITH HIGH PRESSURE VALVE CONTROL BASED ON COEFFICIENT OF PERFORMANCE

CROSS-REFERENCE TO RELATED PATENT APPLICATION

This application claims the benefit of and priority to U.S. Provisional Patent Application No. 62/711,056 filed Jul. 27, 2018, the entire disclosure of which is incorporated by reference herein.

BACKGROUND

The present disclosure relates generally to a refrigeration system and more particularly to a refrigeration system that uses carbon dioxide (i.e., $CO_2$) as a refrigerant. The present disclosure relates more particularly still to a $CO_2$ refrigeration system that controls a high pressure valve based on a coefficient of performance (COP) of the $CO_2$ refrigeration system.

Refrigeration systems are often used to provide cooling to temperature controlled display devices (e.g. cases, merchandisers, etc.) in supermarkets and other similar facilities. Vapor compression refrigeration systems are a type of refrigeration system which provides such cooling by circulating a fluid refrigerant (e.g., a liquid and/or vapor) through a thermodynamic vapor compression cycle. In a vapor compression cycle, the refrigerant is typically compressed to a high temperature high pressure state (e.g., by a compressor of the refrigeration system), cooled/condensed to a lower temperature state (e.g., in a gas cooler or condenser which absorbs heat from the refrigerant), expanded to a lower pressure (e.g., through an expansion valve), and evaporated to provide cooling by absorbing heat into the refrigerant. $CO_2$ refrigeration systems are a type of vapor compression refrigeration system that use $CO_2$ as a refrigerant.

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art and is not admitted to be prior art by inclusion in this section.

SUMMARY

One implementation of the present disclosure is a refrigeration system including an evaporator within which a refrigerant absorbs heat, a gas cooler/condenser within which the refrigerant rejects heat, a compressor operable to circulate the refrigerant between the evaporator and the gas cooler/condenser, a high pressure valve operable to control a pressure of the refrigerant at an outlet of the gas cooler/condenser, and a controller. The controller is configured to automatically generate a setpoint for a measured or calculated variable of the refrigeration system based on a measured temperature of the refrigerant at the outlet of the gas cooler/condenser. The setpoint is generated using a stored relationship between the measured temperature and a maximum estimated coefficient of performance (COP) that can be achieved at the measured temperature. The controller is configured to operate the high pressure valve to drive the measured or calculated variable toward the setpoint.

In some embodiments, the measured or calculated variable is a calculated COP of the refrigeration system the setpoint is a COP setpoint.

In some embodiments, the controller is configured to calculate the COP of the refrigeration system during online operation of the refrigeration system as a function of a change in enthalpy of the refrigerant across the evaporator and a change in enthalpy of the refrigerant across the compressor.

In some embodiments, the controller is configured to calculate the change in enthalpy of the refrigerant across the evaporator and the change in enthalpy of the refrigerant across the compressor based on measurements of the refrigerant obtained during the online operation of the refrigeration system.

In some embodiments, the stored relationship between the measured temperature and the maximum estimated COP that can be achieved defines the maximum estimated COP that can be achieved as a direct function of the measured temperature.

In some embodiments, the controller is configured to determine the maximum estimated COP that can be achieved at each of a plurality of values of the measured temperature. Each value of the measured temperature and a corresponding value of the maximum estimated COP may form a two-dimensional data point. The controller may be configured to perform a regression process to generate the direct function using the two-dimensional data points.

In some embodiments, the measured or calculated variable is a measured pressure of the refrigerant at the outlet of the gas cooler/condenser and the setpoint is a pressure setpoint for the pressure of the refrigerant at the outlet of the gas cooler/condenser.

In some embodiments, the stored relationship between the measured temperature and the maximum estimated COP that can be achieved defines a pressure of the refrigerant at which the maximum estimated COP can be achieved as a direct function of the measured temperature.

In some embodiments, the controller is configured to use the stored relationship to determine the pressure of the refrigerant at which the maximum estimated COP can be achieved as a direct function of the measured temperature and set the pressure setpoint to be equal to the pressure of the refrigerant at which the maximum estimated COP can be achieved.

In some embodiments, the controller is configured to generate the stored relationship by determining, for each of a plurality of values of the measured temperature, a calculated COP of the refrigeration system at each of a plurality of values of a pressure of the refrigerant at the outlet of the gas cooler/condenser and identifying, for each of the plurality of values of the measured temperature, a maximum of the calculated COP values and a corresponding value of the pressure of the refrigerant at which the maximum of the calculated COP values is achieved. Each value of the measured temperature and the corresponding value of the pressure of the refrigerant may form a two-dimensional data point. The controller may generate the stored relationship by performing a regression process using the two-dimensional data points to generate a function that defines the pressure of the refrigerant at which the maximum estimated COP is achieved as a direct function of the measured temperature.

Another implementation of the present disclosure is a method for controlling a refrigeration system. The method includes operating a compressor to circulate a refrigerant between an evaporator within which the refrigerant absorbs heat and a gas cooler/condenser within which the refrigerant rejects heat, automatically generating a setpoint for a measured or calculated variable of the refrigeration system based on a measured temperature of the refrigerant at an outlet of the gas cooler/condenser. The setpoint is generated using a stored relationship between the measured temperature and a maximum estimated coefficient of performance (COP) that can be achieved at the measured temperature. The method includes operating a high pressure valve positioned to control a pressure of the refrigerant at the outlet of the gas cooler/condenser to drive the measured or calculated variable toward the setpoint.

In some embodiments, the measured or calculated variable is a calculated COP of the refrigeration system and the setpoint is a COP setpoint.

In some embodiments, the method includes calculating the COP of the refrigeration system during online operation of the refrigeration system as a function of a change in enthalpy of the refrigerant across the evaporator and a change in enthalpy of the refrigerant across the compressor.

In some embodiments, the method includes calculating the change in enthalpy of the refrigerant across the evaporator and the change in enthalpy of the refrigerant across the compressor based on measurements of the refrigerant obtained during the online operation of the refrigeration system.

In some embodiments, the stored relationship between the measured temperature and the maximum estimated COP that can be achieved defines the maximum estimated COP that can be achieved as a direct function of the measured temperature.

In some embodiments, the method includes determining the maximum estimated COP that can be achieved at each of a plurality of values of the measured temperature. Each value of the measured temperature and a corresponding value of the maximum estimated COP may form a two-dimensional data point. The method may include performing a regression process to generate the direct function using the two-dimensional data points.

In some embodiments, the measured or calculated variable is a measured pressure of the refrigerant at the outlet of the gas cooler/condenser and the setpoint is a pressure setpoint for the pressure of the refrigerant at the outlet of the gas cooler/condenser.

In some embodiments, the stored relationship between the measured temperature and the maximum estimated COP that can be achieved defines a pressure of the refrigerant at which the maximum estimated COP can be achieved as a direct function of the measured temperature.

In some embodiments, the method includes using the stored relationship to determine the pressure of the refrigerant at which the maximum estimated COP can be achieved as a direct function of the measured temperature and setting the pressure setpoint to be equal to the pressure of the refrigerant at which the maximum estimated COP can be achieved.

In some embodiments, the method includes generating the stored relationship by determining, for each of a plurality of values of the measured temperature, a calculated COP of the refrigeration system at each of a plurality of values of a pressure of the refrigerant at the outlet of the gas cooler/condenser and identifying, for each of the plurality of values of the measured temperature, a maximum of the calculated COP values and a corresponding value of the pressure of the refrigerant at which the maximum of the calculated COP values is achieved. Each value of the measured temperature and the corresponding value of the pressure of the refrigerant may form a two-dimensional data point. The method may include performing a regression process using the two-dimensional data points to generate a function that defines the pressure of the refrigerant at which the maximum estimated COP is achieved as a direct function of the measured temperature.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

$CO_2$ Refrigeration System

Referring generally to the FIGURES, a $CO_2$ refrigeration system is shown, according to various exemplary embodiments. The $CO_2$ refrigeration system may be a vapor compression refrigeration system which uses primarily carbon dioxide (i.e., $CO_2$) as a refrigerant. In some implementations, the $CO_2$ refrigeration system is used to provide cooling for temperature controlled display devices in a supermarket or other similar facility.

Figure 1:
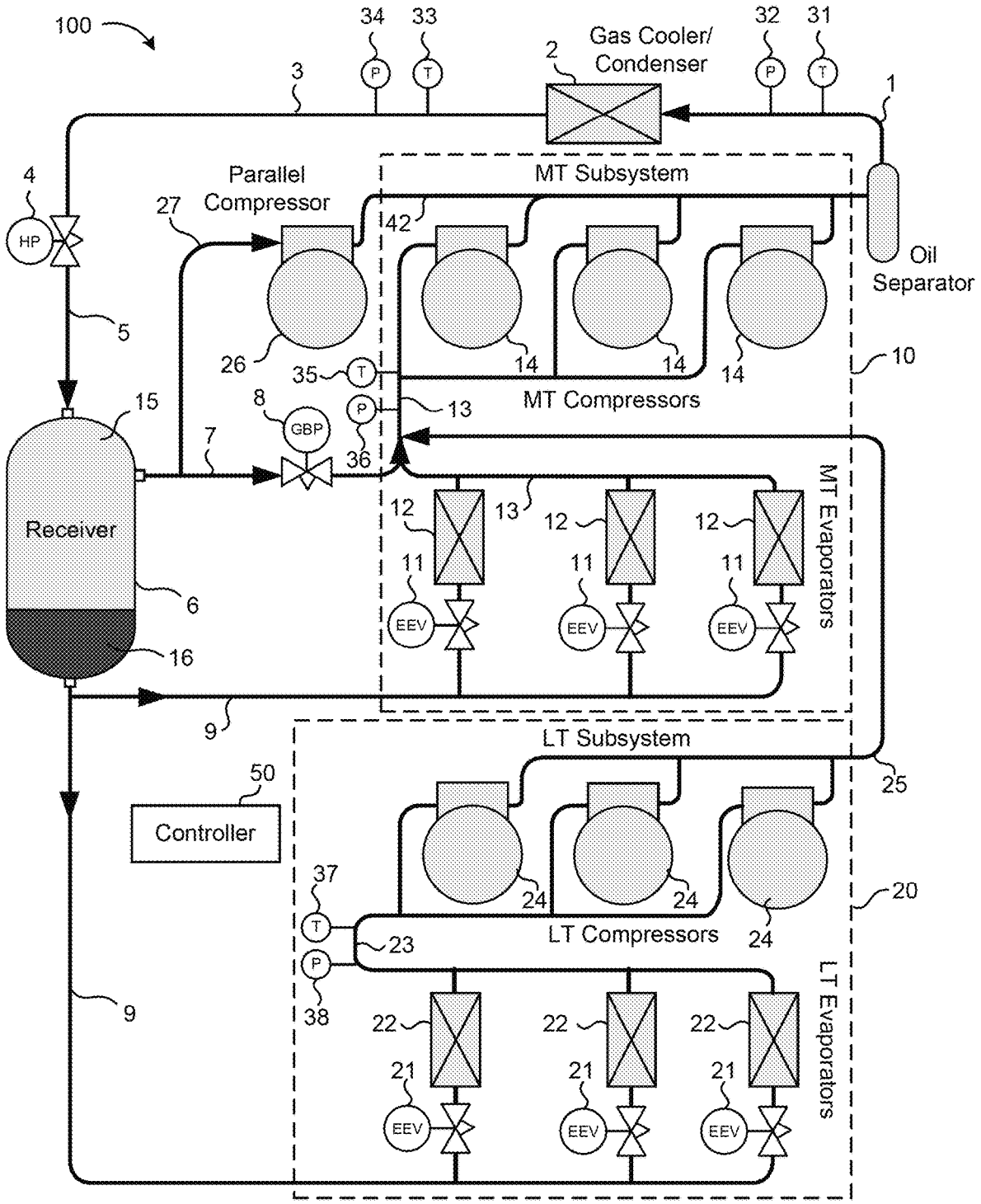
FIG. 1 is a block diagram of a $CO_2$ refrigeration system, according to an exemplary embodiment.

Referring now to FIG. 1, a $CO_2$ refrigeration system 100 is shown, according to an exemplary embodiment. $CO_2$ refrigeration system 100 may be a vapor compression refrigeration system which uses primarily carbon dioxide ($CO_2$) as a refrigerant. However, it is contemplated that other refrigerants can be substituted for $CO_2$ without departing from the teachings of the present disclosure. $CO_2$ refrigeration system 100 and is shown to include a system of pipes, conduits, or other fluid channels (e.g., fluid conduits 1, 3, 5, 7, 9, 13, 23, 27, and 42) for transporting the $CO_2$ refrigerant between various components of $CO_2$ refrigeration system 100. The components of $CO_2$ refrigeration system 100 are shown to include a gas cooler/condenser 2, a high pressure valve 4, a receiver 6, a gas bypass valve 8, a medium-temperature ("MT") subsystem 10, and a low-temperature ("LT") subsystem 20.

Gas cooler/condenser 2 may be a heat exchanger or other similar device for removing heat from the $CO_2$ refrigerant. Gas cooler/condenser 2 is shown receiving $CO_2$ vapor from fluid conduit 1. In some embodiments, the $CO_2$ vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other embodiments, gas cooler/condenser 2 may cool the $CO_2$ vapor (e.g., by removing superheat) without condensing the $CO_2$ vapor into $CO_2$ liquid (e.g., if system operation is in a supercritical region). In some embodiments, the cooling/condensation process is an isobaric process. Gas cooler/condenser 2 is shown outputting the cooled and/or condensed $CO_2$ refrigerant into fluid conduit 3.

In some embodiments, $CO_2$ refrigeration system 100 includes a temperature sensor 31 and a pressure sensor 32 configured to measure the temperature and pressure of the $CO_2$ refrigerant at the inlet of gas cooler/condenser 2. Sensors 31 and 32 can be installed along fluid conduit 1 (as shown in FIG. 1), within gas cooler/condenser 2, or otherwise positioned to measure the temperature and pressure of the $CO_2$ refrigerant entering gas cooler/condenser 2. Similarly, $CO_2$ refrigeration system 100 may include a temperature sensor 33 and a pressure sensor 34 configured to measure the temperature and pressure of the $CO_2$ refrigerant at the outlet of gas cooler/condenser 2. Sensors 33 and 34 can be installed along fluid conduit 3 (as shown in FIG. 1), within gas cooler/condenser 2, or otherwise positioned to measure the temperature and pressure of the $CO_2$ refrigerant exiting gas cooler/condenser 2.

High pressure valve 4 receives the cooled and/or condensed $CO_2$ refrigerant from fluid conduit 3 and outputs the $CO_2$ refrigerant to fluid conduit 5. High pressure valve 4 may control the pressure of the $CO_2$ refrigerant in gas cooler/condenser 2 by controlling an amount of $CO_2$ refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the $CO_2$ refrigerant to expand to a lower pressure state. The expansion process may be an isenthalpic and/or adiabatic expansion process, resulting in a flash evaporation of the high pressure $CO_2$ refrigerant to a lower pressure, lower temperature state. The expansion process may produce a liquid/vapor mixture (e.g., having a thermodynamic quality between 0 and 1). In some embodiments, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiver 6. High pressure valve 4 can be operated automatically by controller 50, as described in greater detail with reference to FIG. 2.

Receiver 6 collects the $CO_2$ refrigerant from fluid conduit 5. In some embodiments, receiver 6 may be a flash tank or other fluid reservoir. Receiver 6 includes a $CO_2$ liquid portion 16 and a $CO_2$ vapor portion 15 and may contain a partially saturated mixture of $CO_2$ liquid and $CO_2$ vapor. In some embodiments, receiver 6 separates the $CO_2$ liquid from the $CO_2$ vapor. The $CO_2$ liquid may exit receiver 6 through fluid conduits 9. Fluid conduits 9 may be liquid headers leading to MT subsystem 10 and/or LT subsystem 20. The $CO_2$ vapor may exit receiver 6 through fluid conduit 7. Fluid conduit 7 is shown leading the $CO_2$ vapor to a gas bypass valve 8 and a parallel compressor 26 (described in greater detail below).

Still referring to FIG. 1, MT subsystem 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some embodiments, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some embodiments, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one embodiment, the $CO_2$ refrigerant is fully evaporated in MT evaporators 12. In some embodiments, the evaporation process may be an isobaric process. MT evaporators 12 are shown outputting the $CO_2$ refrigerant via suction line 13, leading to MT compressors 14.

In some embodiments, $CO_2$ refrigeration system 100 includes a temperature sensor 35 and a pressure sensor 36 configured to measure the temperature and pressure of the $CO_2$ refrigerant within suction line 13. Sensors 35 and 36 can be installed along suction line 13 (as shown in FIG. 1), at the outlet of MT evaporators 12, at the inlet of MT compressors 14, or otherwise positioned to measure the temperature and pressure of the $CO_2$ refrigerant entering MT compressors 14.

MT compressors 14 compress the $CO_2$ refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the $CO_2$ discharge gas exits MT compressors 14 and flows through fluid conduit 1 into gas cooler/condenser 2.

Still referring to FIG. 1, LT subsystem 20 is shown to include one or more expansion valves 21, one or more LT evaporators 22, and one or more LT compressors 24. In various embodiments, any number of expansion valves 21, LT evaporators 22, and LT compressors 24 may be present. In some embodiments, LT subsystem 20 may be omitted and the $CO_2$ refrigeration system 100 may operate with an AC module or parallel compressor 26 interfacing with only MT subsystem 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22. Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some embodiments, expansion valves 21 may expand the $CO_2$ refrigerant to a lower pressure than expansion valves 11, thereby resulting in a lower temperature $CO_2$ refrigerant. Accordingly, LT subsystem 20 may be used in conjunction with a freezer system or other lower temperature display cases.

In some embodiments, $CO_2$ refrigeration system 100 includes a temperature sensor 37 and a pressure sensor 38 configured to measure the temperature and pressure of the $CO_2$ refrigerant within suction line 23. Sensors 37 and 38 can be installed along suction line 23 (as shown in FIG. 1), at the outlet of LT evaporators 22, at the inlet of LT compressors 24, or otherwise positioned to measure the temperature and pressure of the $CO_2$ refrigerant entering LT compressors 24.

LT evaporators 22 are shown receiving the cooled and expanded $CO_2$ refrigerant from expansion valves 21. In some embodiments, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some embodiments, the evaporation process may be an isobaric process. LT evaporators 22 are shown outputting the $CO_2$ refrigerant via suction line 23, leading to LT compressors 24.

LT compressors 24 compress the $CO_2$ refrigerant. In some embodiments, LT compressors 24 may compress the $CO_2$ refrigerant to a pressure of approximately 30 bar (e.g., about 425 psig) having a saturation temperature of approximately 23° F. (e.g., about −5° C.). In some embodiments, LT compressors 24 operate in a subcritical mode. LT compressors 24 are shown outputting the $CO_2$ refrigerant through discharge line 25. Discharge line 25 may be fluidly connected with the suction (e.g., upstream) side of MT compressors 14.

Still referring to FIG. 1, $CO_2$ refrigeration system 100 is shown to include a gas bypass valve 8. Gas bypass valve 8 may receive the $CO_2$ vapor from fluid conduit 7 and output the $CO_2$ refrigerant to MT subsystem 10. In some embodiments, gas bypass valve 8 is arranged in series with MT compressors 14. In other words, $CO_2$ vapor from receiver 6 may pass through both gas bypass valve 8 and MT compressors 14. MT compressors 14 may compress the $CO_2$ vapor passing through gas bypass valve 8 from a low pressure state (e.g., approximately 30 bar or lower) to a high pressure state (e.g., 45-100 bar).

Gas bypass valve 8 may be operated by controller 50 to regulate or control the pressure within receiver 6 (e.g., by adjusting an amount of $CO_2$ refrigerant permitted to pass through gas bypass valve 8). For example, gas bypass valve 8 may be adjusted (e.g., variably opened or closed) to adjust the mass flow rate, volume flow rate, or other flow rates of the $CO_2$ refrigerant through gas bypass valve 8. Gas bypass valve 8 may be opened and closed (e.g., manually, automatically, by a controller, etc.) as needed to regulate the pressure within receiver 6.

In some embodiments, gas bypass valve 8 includes a sensor for measuring a flow rate (e.g., mass flow, volume flow, etc.) of the $CO_2$ refrigerant through gas bypass valve 8. In other embodiments, gas bypass valve 8 includes an indicator (e.g., a gauge, a dial, etc.) from which the position of gas bypass valve 8 may be determined. This position may be used to determine the flow rate of $CO_2$ refrigerant through gas bypass valve 8, as such quantities may be proportional or otherwise related.

In some embodiments, gas bypass valve 8 may be a thermal expansion valve (e.g., if the pressure on the downstream side of gas bypass valve 8 is lower than the pressure in fluid conduit 7). According to one embodiment, the pressure within receiver 6 is regulated by gas bypass valve 8 to a pressure of approximately 38 bar, which corresponds to about 37° F. Advantageously, this pressure/temperature state may facilitate the use of copper tubing/piping for the downstream $CO_2$ lines of the system. Additionally, this pressure/temperature state may allow such copper tubing to operate in a substantially frost-free manner.

In some embodiments, the $CO_2$ vapor that is bypassed through gas bypass valve 8 is mixed with the $CO_2$ refrigerant gas exiting MT evaporators 12 (e.g., via suction line 13). The bypassed $CO_2$ vapor may also mix with the discharge $CO_2$ refrigerant gas exiting LT compressors 24 (e.g., via discharge line 25). The combined $CO_2$ refrigerant gas may be provided to the suction side of MT compressors 14.

In some embodiments, the pressure immediately downstream of gas bypass valve 8 (i.e., in suction line 13) is lower than the pressure immediately upstream of gas bypass valve 8 (i.e., in fluid conduit 7). Therefore, the $CO_2$ vapor passing through gas bypass valve 8 and MT compressors 14 may be expanded (e.g., when passing through gas bypass valve 8) and subsequently recompressed (e.g., by MT compressors 14). This expansion and recompression may occur without any intermediate transfers of heat to or from the $CO_2$ refrigerant, which can be characterized as an inefficient energy usage.

Still referring to FIG. 1, $CO_2$ refrigeration system 100 is shown to include a parallel compressor 26. Parallel compressor 26 may be arranged in parallel with other compressors of $CO_2$ refrigeration system 100 (e.g., MT compressors 14, LT compressors 24, etc.). Although only one parallel compressor 26 is shown, any number of parallel compressors may be present. Parallel compressor 26 may be fluidly connected with receiver 6 and/or fluid conduit 7 via a connecting line 27. Parallel compressor 26 may be used to draw non-condensed $CO_2$ vapor from receiver 6 as a means for pressure control and regulation. Advantageously, using parallel compressor 26 to effectuate pressure control and regulation may provide a more efficient alternative to traditional pressure regulation techniques such as bypassing $CO_2$ vapor through bypass valve 8 to the lower pressure suction side of MT compressors 14.

In some embodiments, parallel compressor 26 may be operated (e.g., by a controller 50) to achieve a desired pressure within receiver 6. For example, controller 50 may receive pressure measurements from a pressure sensor monitoring the pressure within receiver 6 and may activate or deactivate parallel compressor 26 based on the pressure measurements. When active, parallel compressor 26 compresses the $CO_2$ vapor received via connecting line 27 and discharges the compressed vapor into discharge line 42.

Discharge line 42 may be fluidly connected with fluid conduit 1. Accordingly, parallel compressor 26 may operate in parallel with MT compressors 14 by discharging the compressed $CO_2$ vapor into a shared fluid conduit (e.g., fluid conduit 1).

Parallel compressor 26 may be arranged in parallel with both gas bypass valve 8 and with MT compressors 14. $CO_2$ vapor exiting receiver 6 may pass through either parallel compressor 26 or the series combination of gas bypass valve 8 and MT compressors 14. Parallel compressor 26 may receive the $CO_2$ vapor at a relatively higher pressure (e.g., from fluid conduit 7) than the $CO_2$ vapor received by MT compressors 14 (e.g., from suction line 13). This differential in pressure may correspond to the pressure differential across gas bypass valve 8. In some embodiments, parallel compressor 26 may require less energy to compress an equivalent amount of $CO_2$ vapor to the high pressure state (e.g., in fluid conduit 1) as a result of the higher pressure of $CO_2$ vapor entering parallel compressor 26. Therefore, the parallel route including parallel compressor 26 may be a more efficient alternative to the route including gas bypass valve 8 and MT compressors 14.

In some embodiments, gas bypass valve 8 is omitted and the pressure within receiver 6 is regulated using parallel compressor 26. In other embodiments, parallel compressor 26 is omitted and the pressure within receiver 6 is regulated using gas bypass valve 8. In other embodiments, both gas bypass valve 8 and parallel compressor 26 are used to regulate the pressure within receiver 6. All such variations are within the scope of the present disclosure.

Controller

Figure 2:
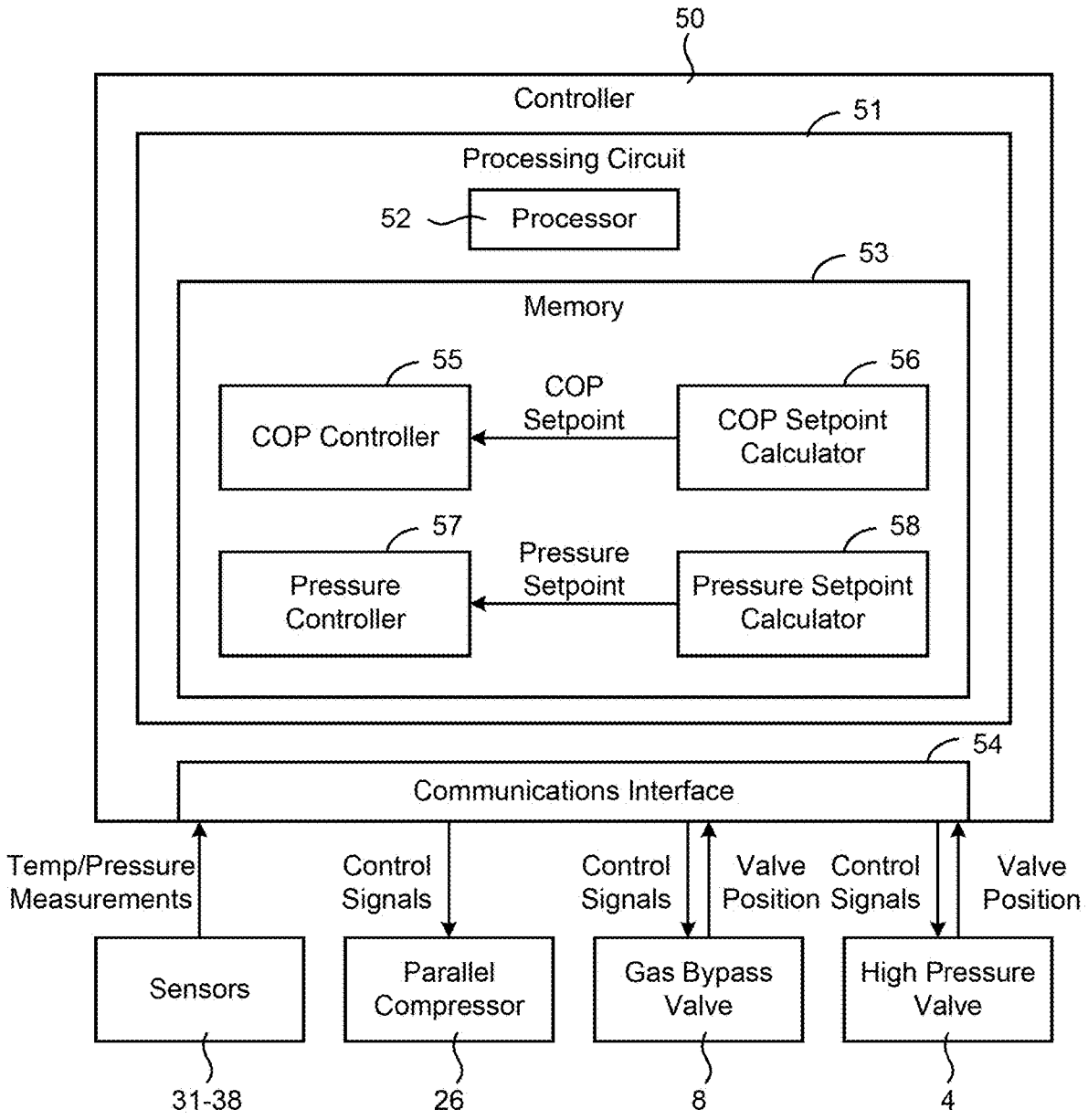
FIG. 2 is a block diagram of a controller configured to control the $CO_2$ refrigeration system of FIG. 1, according to an exemplary embodiment.

Referring now to FIG. 2, a block diagram illustrating controller 50 in greater detail is shown, according to an exemplary embodiment. Controller 50 may receive signals from one or more measurement devices (e.g., pressure sensors, temperature sensors, flow sensors, etc.) located within $CO_2$ refrigeration system 100. For example, controller 50 is shown receiving a temperature and pressure measurements from sensors 31-38, a valve position signal from gas bypass valve 8, and a valve position signal from high pressure valve 4. Controller 50 may use the input signals to determine appropriate control actions for controllable devices of $CO_2$ refrigeration system 100 (e.g., compressors 14 and 24, parallel compressor 26, valves 4, 8, 11, and 21, flow diverters, power supplies, etc.). For example, controller 50 is shown providing control signals to parallel compressor 26, gas bypass valve 8, and high pressure valve 4.

In some embodiments, controller 50 is configured to operate gas bypass valve 8 and/or parallel compressor 26 to maintain the $CO_2$ pressure within receiver 6 at a desired setpoint or within a desired range. In some embodiments, controller 50 operates gas bypass valve 8 and parallel compressor 26 based on the temperature of the $CO_2$ refrigerant at the outlet of gas cooler/condenser 2. In other embodiments, controller 50 operates gas bypass valve 8 and parallel compressor 26 based a flow rate (e.g., mass flow, volume flow, etc.) of $CO_2$ refrigerant through gas bypass valve 8. Controller 50 may use a valve position of gas bypass valve 8 as a proxy for $CO_2$ refrigerant flow rate. In some embodiments, controller 50 operates high pressure valve 4 and expansion valves 11 and 21 to regulate the flow of refrigerant in system 100.

In some embodiments, controller 50 is configured to operate high pressure valve 4 to control (e.g., optimize) a coefficient of performance (COP) of $CO_2$ refrigeration system 100. The COP of $CO_2$ refrigeration system 100 can be defined as the change in enthalpy of the $CO_2$ refrigerant across MT evaporators 12 and/or LT evaporators 22 $\Delta H_{evap}$ divided by the change in enthalpy of the $CO_2$ refrigerant across MT compressors 14 and/or LT compressors 24 $\Delta H_{comp}$ as shown in the following equation:

$$COP = \frac{\Delta H_{evap}}{\Delta H_{comp}}$$

where $\Delta H_{evap}$ and $\Delta H_{comp}$ are calculated based on the temperature and pressure measurements received from sensors 31-38.

In some embodiments, controller 50 is configured to optimize the COP of $CO_2$ refrigeration system 100 by performing online (i.e., real-time) calculations of $\Delta H_{evap}$, $\Delta H_{comp}$, and the corresponding COP during operation of $CO_2$ refrigeration system 100. Controller 50 can then operate high pressure valve 4 to drive the calculated COP to a setpoint. In other embodiments, controller 50 is configured to optimize the COP of $CO_2$ refrigeration system 100 by calculating a pressure setpoint for high pressure valve 4 that is estimated to achieve an optimal COP for $CO_2$ refrigeration system 100. Controller 50 can then operate high pressure valve 4 to drive the pressure of the $CO_2$ refrigerant at the outlet of gas cooler/condenser 2 to the calculated pressure setpoint. Both of these techniques for optimizing the COP of $CO_2$ refrigeration system 100 are described in greater detail below. In general, controller 50 may operate to automatically generate a setpoint for a measured or calculated variable of $CO_2$ refrigeration system 100 (e.g., the measured pressure of the $CO_2$ refrigerant at the outlet of gas cooler/condenser 2 or the calculated COP of $CO_2$ refrigeration system 100) and then operate high pressure valve 4 to drive the measured or calculated variable to the setpoint.

Controller 50 may include feedback control functionality for adaptively operating the various components of $CO_2$ refrigeration system 100. For example, controller 50 may receive a setpoint (e.g., a temperature setpoint, a pressure setpoint, a flow rate setpoint, a power usage setpoint, etc.) and operate one or more components of system 100 to achieve the setpoint. The setpoint may be specified by a user (e.g., via a user input device, a graphical user interface, a local interface, a remote interface, etc.) or automatically determined by controller 50 based on a history of data measurements. In some embodiments, controller 50 includes some or all of the features of the controller described in P.C.T. Patent Application No. PCT/US2016/044164 filed Jul. 27, 2016, the entire disclosure of which is incorporated by reference herein.

Controller 50 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some embodiments, controller 50 is a local controller for $CO_2$ refrigeration system 100. In other embodiments, controller 50 is a supervisory controller for a plurality of controlled subsystems (e.g., a refrigeration system, an AC system, a lighting system, a security system, etc.). For example, controller 50 may be a controller for a comprehensive building management system incorporating $CO_2$ refrigeration system 100. Controller 50 may be implemented locally, remotely, or as part of a cloud-hosted suite of building management applications.

Still referring to FIG. 2, controller 50 is shown to include a communications interface 54 and a processing circuit 51. Communications interface 54 can be or include wired or wireless interfaces (e.g., jacks, antennas, transmitters, receivers, transceivers, wire terminals, etc.) for conducting electronic data communications. For example, communications interface 54 may be used to conduct communications with gas bypass valve 8, parallel compressor 26, compressors 14 and 24, high pressure valve 4, various data acquisition devices within $CO_2$ refrigeration system 100 (e.g., temperature sensors, pressure sensors, flow sensors, etc.) and/or other external devices or data sources. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 54 can include an Ethernet card and port for sending and receiving data via an Ethernet-based communications link or network. In another example, communications interface 54 can include a Wi-Fi transceiver or a cellular or mobile phone transceiver for communicating via a wireless communications network.

Processing circuit 51 is shown to include a processor 52 and memory 53. Processor 52 can be implemented as a general purpose processor, an application specific integrated circuit (ASIC), one or more field programmable gate arrays (FPGAs), a group of processing components, a microcontroller, or other suitable electronic processing components. Memory 53 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 53 may be or include volatile memory or non-volatile memory. Memory 53 may include database components, object code components, script components, or any other type of information structure for supporting the various activities and information structures described in the present application. According to an exemplary embodiment, memory 53 is communicably connected to processor 52 via processing circuit 51 and includes computer code for executing (e.g., by processing circuit 51 and/or processor 52) one or more processes or control features described herein.

Pressure Control Based on Real-Time Estimation of COP

Figure 3:
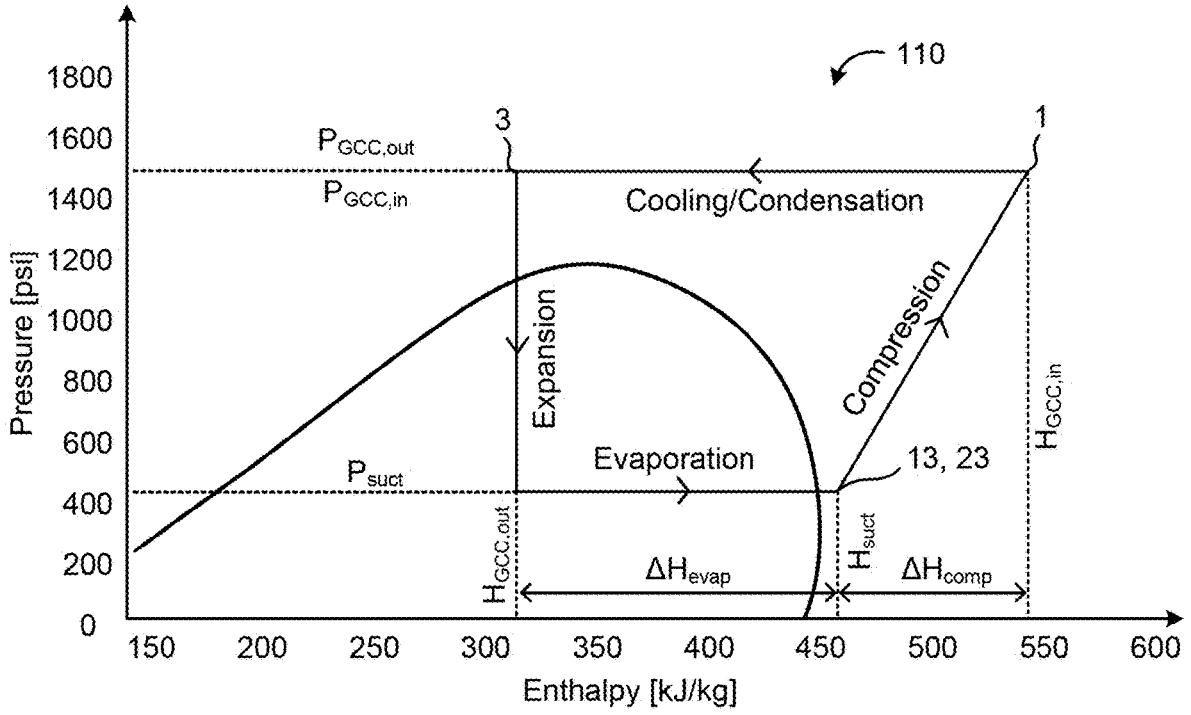
FIG. 3 is a pressure-enthalpy diagram illustrating the pressures and enthalpies of the $CO_2$ refrigerant at various locations within the $CO_2$ refrigeration system of FIG. 1, according to an exemplary embodiment.

Referring now to FIGS. 2 and 3, controller 50 is shown to include a COP controller 55 and a COP setpoint calculator 56. COP controller 55 can be configured to perform an online (i.e., real-time) calculation of the actual COP of $CO_2$ refrigeration system 100 based on the measured temperatures and pressures received from sensors 31-38. The COP of $CO_2$ refrigeration system 100 can be defined as the change in enthalpy of the $CO_2$ refrigerant across MT evaporators 12 and/or LT evaporators 22 $\Delta H_{evap}$ divided by the change in enthalpy of the $CO_2$ refrigerant across MT compressors 14 and/or LT compressors 24 $\Delta H_{comp}$ as shown in the following equation:

$$COP = \frac{\Delta H_{evap}}{\Delta H_{comp}}$$

where $\Delta H_{evap}$ and $\Delta H_{comp}$ are calculated based on the temperature and pressure measurements received from sensors 31-38.

In some embodiments, $\Delta H_{evap}$ is a function (e.g., average, summation, etc.) of the change in enthalpy $\Delta H_{evap,MT}$ of the $CO_2$ refrigerant across MT evaporators 12 and the change in enthalpy$\Delta H_{evap,LT}$ of the $CO_2$ refrigerant across LT evaporators 22. In other embodiments, $\Delta H_{evap}$ is either the change in enthalpy $\Delta H_{evap,MT}$ of the $CO_2$ refrigerant across MT evaporators 12 or the change in enthalpy $\Delta H_{evap,LT}$ of the $CO_2$ refrigerant across LT evaporators 22. Similarly, $\Delta H_{comp}$ may be a function (e.g., average, summation, etc.) of the change in enthalpy $\Delta H_{comp,MT}$ of the $CO_2$ refrigerant across MT compressors 14 and the change in enthalpy $\Delta H_{comp,LT}$ of the $CO_2$ refrigerant across LT compressors 24. In other embodiments, $\Delta H_{comp}$ is either the change in enthalpy $\Delta H_{comp,MT}$ of the $CO_2$ refrigerant across MT compressors 14 or the change in enthalpy $\Delta H_{comp,LT}$ of the $CO_2$ refrigerant across LT compressors 24.

It should be noted that any variable, measurement, or term (e.g., enthalpies, temperatures, pressures, etc.) described in the present disclosure with the conjunction "and/or" is intended to encompass one, both, or a function of the variables, measurements, or terms joined by the conjunction. For example, the enthalpy of the $CO_2$ refrigerant at the suction of MT compressors 14 and/or LT compressors 24 may include only the enthalpy of the $CO_2$ refrigerant at the suction of MT compressors 14, only the enthalpy of the $CO_2$ refrigerant at the suction of LT compressors 24, or a function thereof. The same interpretation should be applied to temperatures, pressures, or any other variables, measurements, or terms joined by the conjunction "and/or" in the present disclosure.

FIG. 3 is a pressure-enthalpy diagram 110 illustrating the pressures and enthalpies of the $CO_2$ refrigerant at various locations within $CO_2$ refrigeration system 100 is shown, according to an exemplary embodiment. In fluid conduit 1 at the inlet of gas cooler/condenser 2, the $CO_2$ refrigerant has an enthalpy of $H_{GCC,in}$ and a pressure of $P_{GCC,in}$. In fluid conduit 3 at the outlet of gas cooler/condenser 2, the $CO_2$ refrigerant has an enthalpy of $H_{GCC,out}$ and a pressure of $P_{GCC,out}$. In suction line 13 at the suction of MT compressors 14 and/or suction line 23 at the suction of LT compressors 24, the $CO_2$ refrigerant has an enthalpy of $H_{suct}$ and a pressure of $P_{suct}$.

The change in enthalpy $\Delta H_{comp}$ across MT compressors 14 and/or LT compressors 24 is equal to the difference between the enthalpy $H_{GCC,in}$ of the $CO_2$ refrigerant at the inlet of gas cooler/condenser 2 and the enthalpy $H_{suct}$ of the $CO_2$ refrigerant at the suction of MT compressors 14 and/or LT compressors 24. The change in enthalpy $\Delta H_{evap}$ across MT evaporators 12 and/or LT evaporators 22 is equal to the difference between the enthalpy $H_{suct}$ of the $CO_2$ refrigerant at the suction of MT compressors 14 and/or LT compressors 24 and the enthalpy $H_{GCC,out}$ of the $CO_2$ refrigerant at the outlet of gas cooler/condenser 2. Because the expansion of the $CO_2$ refrigerant by high pressure valve 4 and expansion valves 11 is isenthalpic, the enthalpy $H_{GCC,out}$ of the $CO_2$ refrigerant at the outlet of gas cooler/condenser 2 is equivalent to the enthalpy of the $CO_2$ refrigerant at the inlet of MT evaporators 12 and/or LT evaporators 22.

COP controller 55 can calculate $\Delta H_{evap}$ using the following equation:

$$\Delta H_{evap} = H_{suct}(P_{suct}, T_{suct}) - H_{suct}(P_{GCC,out}, T_{GCC,out})$$

where $H_{suct}(P_{suct}, T_{suct})$ is the enthalpy of the $CO_2$ refrigerant at the suction of MT compressors 14 (i.e., within suction line 13) and/or the enthalpy of the $CO_2$ refrigerant at the suction of LT compressors 24 (i.e., within suction line 23), $P_{suct}$ is the pressure of the $CO_2$ refrigerant at the suction of MT compressors 14 (i.e., the pressure measured by pressure sensor 36) and/or the pressure of the $CO_2$ refrigerant at the suction of LT compressors 24 (i.e., the pressure measured by pressure sensor 38), $T_{suct}$ is the temperature of the $CO_2$ refrigerant at the suction of MT compressors 14 (i.e., the temperature measured by temperature sensor 35) and/or the temperature of the $CO_2$ refrigerant at the suction of LT compressors 24 (i.e., the temperature measured by temperature sensor 37), $H_{GCC,out}(P_{GCC,out}, T_{GCC,out})$ is the enthalpy of the $CO_2$ refrigerant at the outlet of gas cooler/condenser 2 (i.e., within fluid conduit 3), $P_{GCC,out}$ is the pressure of the $CO_2$ refrigerant at the outlet of gas cooler/condenser 2 (i.e., the pressure measured by pressure sensor 34), and $T_{GCC,out}$ is the temperature of the $CO_2$ refrigerant at the outlet of gas cooler/condenser 2 (i.e., the temperature measured by temperature sensor 33).

COP controller 55 can calculate $\Delta H_{comp}$ using the following equation:

$$\Delta H_{comp}=H_{GCC,in}(P_{GCC,in}, T_{GCC,in})-H_{suct}(P_{suct}, T_{suct})$$

where $H_{GCC,in}(P_{GCC,in}, T_{GCC,in})$ is the enthalpy of the $CO_2$ refrigerant at the inlet of gas cooler/condenser 2 (i.e., within fluid conduit 1), $P_{GCC,in}$ is the pressure of the $CO_2$ refrigerant at the inlet of gas cooler/condenser 2 (i.e., the pressure measured by pressure sensor 32), $T_{GCC,in}$ is the temperature of the $CO_2$ refrigerant at the inlet of gas cooler/condenser 2 (i.e., the temperature measured by temperature sensor 31), $H_{suct}(P_{suct}, T_{suct})$ is the enthalpy of the $CO_2$ refrigerant at the suction of MT compressors 14 (i.e., within suction line 13) and/or the enthalpy of the $CO_2$ refrigerant at the suction of LT compressors 24 (i.e., within suction line 23), $P_{suct}$ is the pressure of the $CO_2$ refrigerant at the suction of MT compressors 14 (i.e., the pressure measured by pressure sensor 36) and/or the pressure of the $CO_2$ refrigerant at the suction of LT compressors 24 (i.e., the pressure measured by pressure sensor 38), and $T_{suct}$ is the temperature of the $CO_2$ refrigerant at the suction of MT compressors 14 (i.e., the temperature measured by temperature sensor 35) and/or the temperature of the $CO_2$ refrigerant at the suction of LT compressors 24 (i.e., the temperature measured by temperature sensor 37).

COP controller 55 can use the temperature and pressure measurements from sensors 31-38 to calculate $H_{suct}(P_{suct}, T_{suct})$, $H_{GCC,in}(P_{GCC,in}, T_{GCC,in})$, and $H_{GCC,out}(P_{GCC,out}, T_{GCC,out})$. The enthalpy of the $CO_2$ refrigerant at any given location within $CO_2$ refrigeration system 100 is a function of the temperature and pressure of the $CO_2$ refrigerant at that location and can be calculated based on the temperature and pressure measurements recorded by sensors 31-38. COP controller 55 can then use the calculated enthalpies to calculate $\Delta H_{evap}$, $\Delta H_{comp}$, and the COP of $CO_2$ refrigeration system 100 as previously described. COP controller 55 may receive a COP setpoint from COP setpoint calculator 56 and can adjust the position of high pressure valve 4 to drive the calculated COP toward the COP setpoint.

Figure 4:
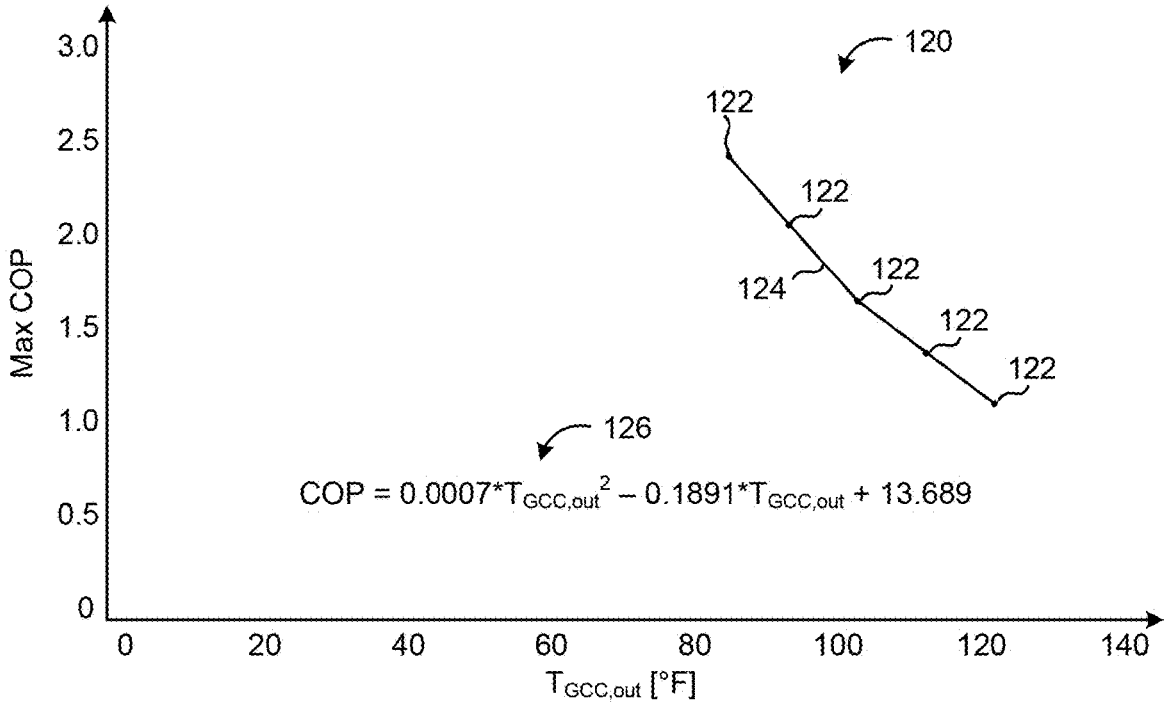
FIG. 4 is a graph illustrating a relationship between the temperature of the $CO_2$ refrigerant at the outlet of a gas cooler/condenser and a maximum coefficient of performance (COP) of the $CO_2$ refrigeration system of FIG. 1, according to an exemplary embodiment.

Referring now to FIGS. 2 and 4, COP setpoint calculator 56 can be configured to determine an optimal COP setpoint for COP controller 55. In some embodiments, COP setpoint calculator 56 determines the optimal COP setpoint based on a measured temperature $T_{GCC,out}$ of the $CO_2$ refrigerant at the outlet of gas cooler/condenser 2 (i.e., the temperature measured by temperature sensor 33). For example, COP setpoint calculator 56 may calculate the optimal COP setpoint as a function of the measured temperature $T_{GCC,out}$ using the following equation:

$$COP=0.0007*T_{GCC,out}^2-0.189122*T_{GCC,out}+13.689$$

which is plotted graphically in graph 120 shown in FIG. 4.

In some embodiments, COP setpoint calculator 56 performs one or more simulations to determine a maximum COP value for each of a plurality of values of $T_{GCC,out}$. The maximum COP value for each value of $T_{GCC,out}$ indicates the maximum COP that can be achieved given the value of $T_{GCC,out}$. Each value of $T_{GCC,out}$ and the corresponding value of the maximum COP forms a two-dimensional data point 122 (i.e., $(T_{GCC,out}, COP_{max})$). COP setpoint calculator 56 can perform a regression process to fit a line 124 to the set of data points 122 and can estimate a function 126 that represents the relationship between $T_{GCC,out}$ and the maximum COP. Function 126 can be generated online or offline by COP setpoint calculator 56 using real or simulated historical data for $CO_2$ refrigeration system 100.

Figure 5:
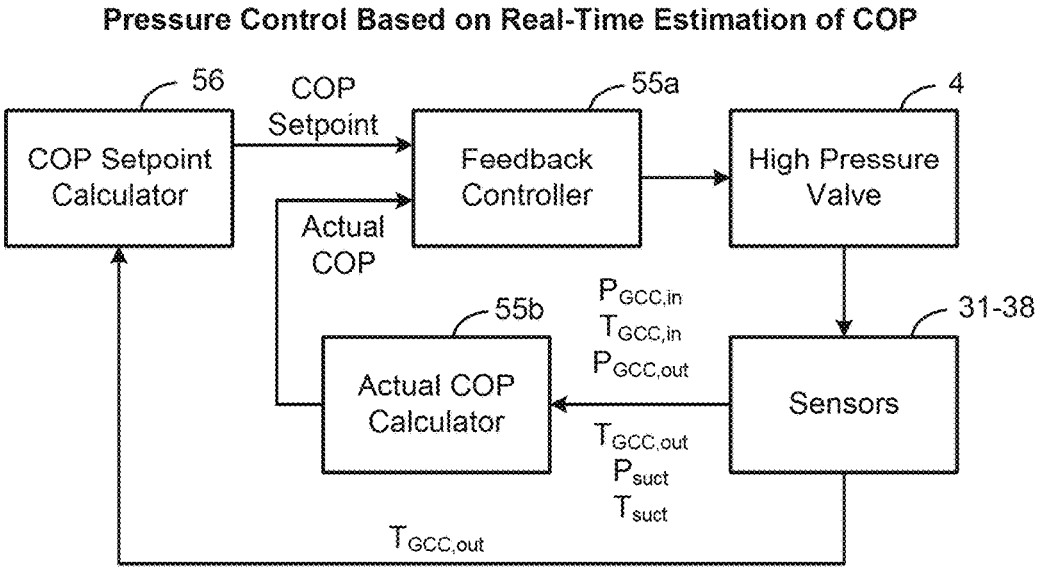
FIG. 5 is block diagram illustrating the operation of the $CO_2$ refrigeration system of FIG. 1 to control the pressure of the $CO_2$ refrigerant based on a real-time estimation of the COP, according to an exemplary embodiment.

Referring now to FIG. 5, a block diagram illustrating the online operation of COP setpoint calculator 56 and COP controller 55 is shown, according to an exemplary embodiment. In FIG. 5, COP controller 55 is shown as two components: a feedback controller 55*a* and an actual COP calculator 55*b*. In online operation, COP setpoint calculator 56 may receive a measurement of $T_{GCC,out}$ from temperature sensor 33 and may use function 126 to calculate the corresponding maximum COP value. COP setpoint calculator 56 may then provide the maximum COP value to feedback controller 55*a* as the COP setpoint. Actual COP calculator 55*b* may receive measurements of $P_{GCC,in}$, $T_{GCC,in}$, $P_{GCC,out}$, $T_{GCC,out}$, $P_{suct}$, and $T_{suct}$ from sensors 31-36 and may use the measured values to calculate the actual COP of $CO_2$ refrigeration system 100. Actual COP calculator 55*b* may provide the actual COP of $CO_2$ refrigeration system 100 to feedback controller 55*a*. Feedback controller 55*a* may operate high pressure valve 4 to drive the actual COP of $CO_2$ refrigeration system 100 toward the COP setpoint using a feedback control process (e.g., PI control, PID control, etc.).

Pressure Control Based on Offline Estimated COP

Figure 6:
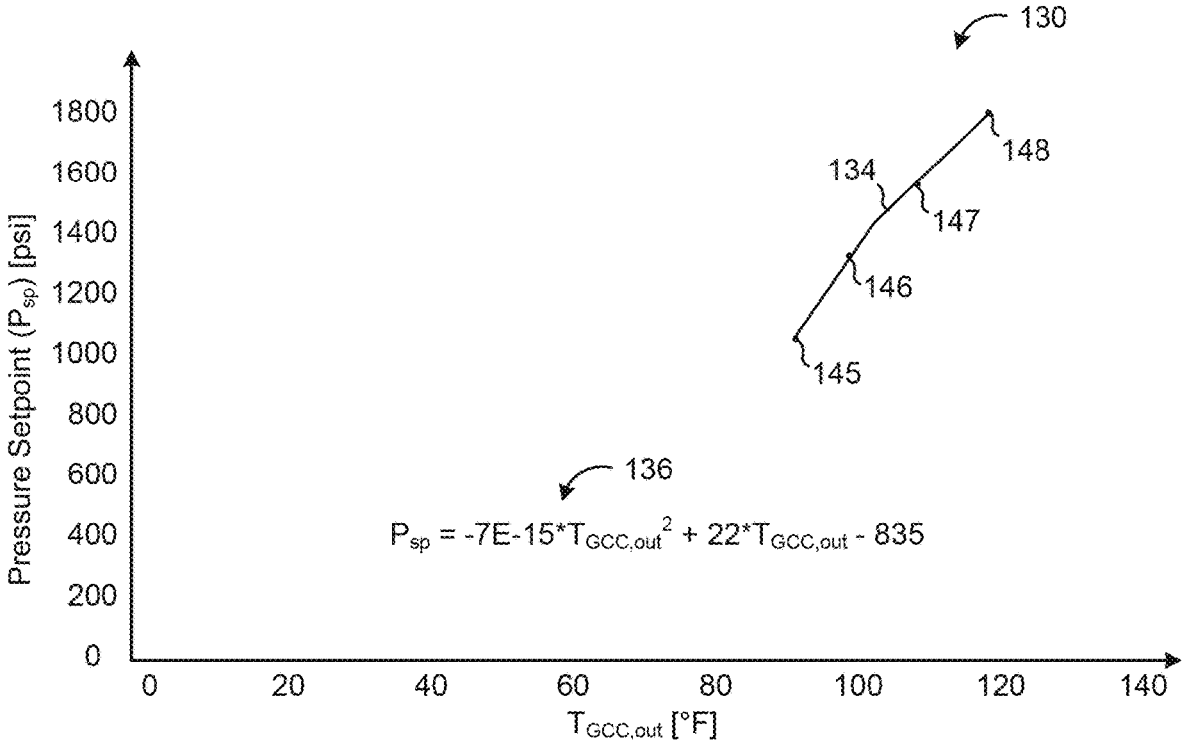
FIG. 6 is a graph illustrating a relationship between the temperature of the $CO_2$ refrigerant at the outlet of a gas cooler/condenser and an optimal pressure setpoint for the $CO_2$ refrigeration system of FIG. 1, according to an exemplary embodiment.
Figure 7:
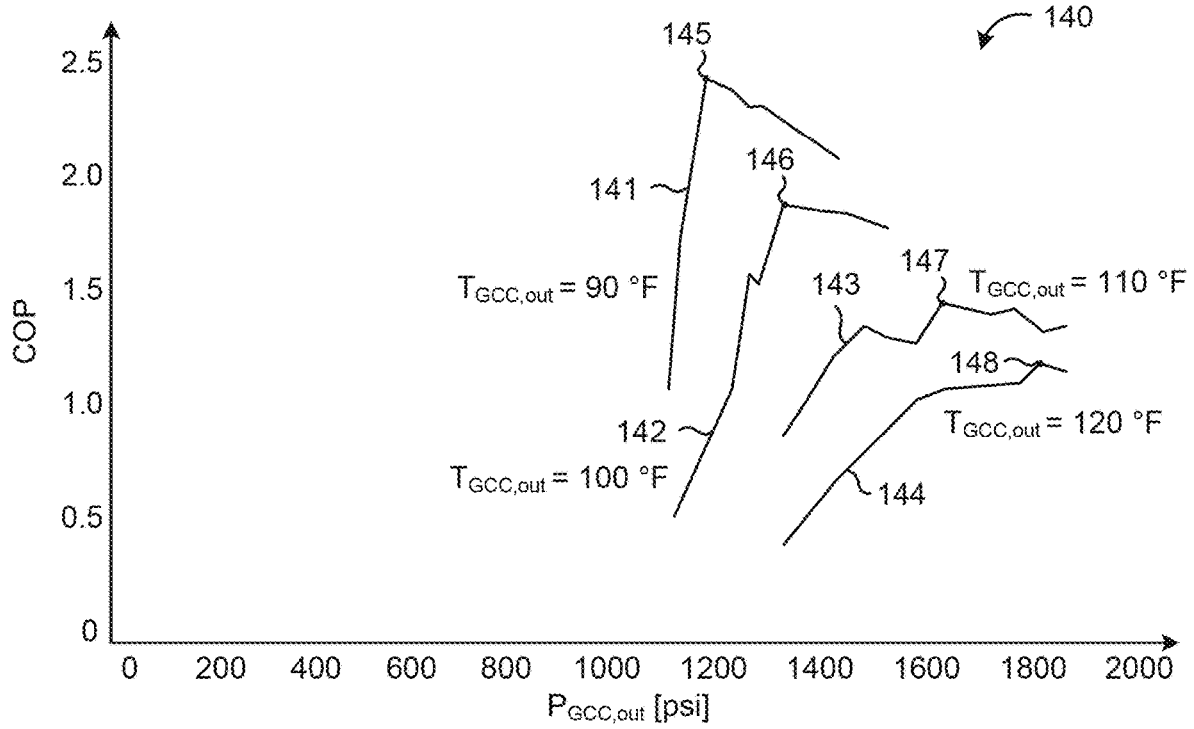
FIG. 7 is a graph illustrating a relationship between the pressure of the $CO_2$ refrigerant at the outlet of a gas cooler/condenser and the COP of the $CO_2$ refrigeration system of FIG. 1 at several values of the temperature of the $CO_2$ refrigerant at the outlet of the gas cooler/condenser, according to an exemplary embodiment.

Referring now to FIGS. 2 and 6-7, controller 50 is shown to include a pressure controller 57 and a pressure setpoint calculator 58. Pressure controller 57 can be configured to operate high pressure valve 4 to control the pressure P GCC,out of the $CO_2$ refrigerant at the outlet of gas cooler/condenser 2. Pressure controller 57 may receive a pressure setpoint from pressure setpoint calculator 58 and may operate high pressure valve 4 to achieve the pressure setpoint.

Pressure setpoint calculator 58 can be configured to determine an optimal pressure setpoint for pressure controller 57. In some embodiments, pressure setpoint calculator 58 determines the optimal pressure setpoint based on a measured temperature $T_{GCC,out}$ of the $CO_2$ refrigerant at the outlet of gas cooler/condenser 2 (i.e., the temperature measured by temperature sensor 33). For example, pressure setpoint calculator 58 may calculate the optimal pressure setpoint as a function of the measured temperature $T_{GCC,out}$ using the following equation:

$$P_{sp}=-7\times10^{-15}*T_{GCC,out}^2+22*T_{GCC,out}-835$$

which is plotted graphically in graph 130 shown in FIG. 6.

In some embodiments, pressure setpoint calculator 58 performs one or more simulations to determine a maximum COP value for each of a plurality of values of $T_{GCC,out}$.Graph 140 shown in FIG. 7 illustrates the result of each simulation. Line 141 indicates the relationship between COP and $P_{GCC,out}$ when $T_{GCC,out}$ is 90° F., line 142 indicates the relationship between COP and $P_{GCC,out}$ when $T_{GCC,out}$ is 100° F., line 143 indicates the relationship between COP and $P_{GCC,out}$ when $T_{GCC,out}$ is 110° F., and line 144 indicates the relationship between COP and $P_{GCC,out}$ when $T_{GCC,out}$ is 120° F. Points 145-148 indicate the maximum COP values that can be achieved at each value of $T_{GCC,out}$ along with the corresponding values of $P_{GCC,out}$.

Each of points 145-148 includes a temperature value (i.e., a value of $T_{GCC,out}$) and a corresponding pressure value (i.e., a value of $P_{GCC,out}$) that results in the maximum COP at that temperature. Pressure setpoint calculator 58 can perform a regression process to fit a line 134 (shown in FIG. 6) to the set of data points 145-148 and can estimate a function 136 that represents the relationship between $T_{GCC,out}$ and the optimal pressure setpoint $P_{sp}$. The optimal pressure setpoints $P_{sp}$, may be defined as the pressure setpoints that achieve the maximum COP at each value of $T_{GCC,out}$. Function 136 can be generated online or offline by pressure setpoint calculator 58 using real or simulated historical data for $CO_2$ refrigeration system 100.

Figure 8:
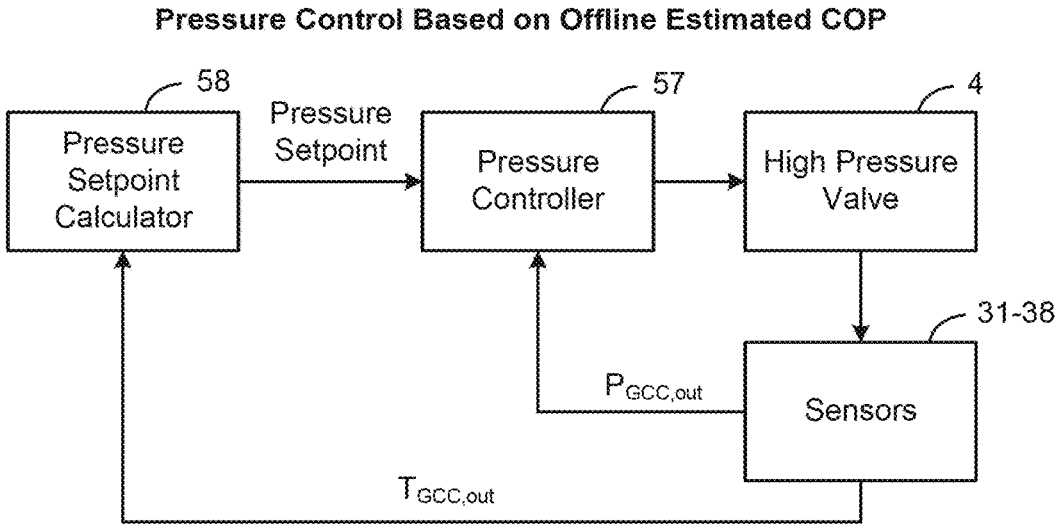
FIG. 8 is block diagram illustrating the operation of the $CO_2$ refrigeration system of FIG. 1 to control the pressure of the $CO_2$ refrigerant based on an offline estimated value of the COP, according to an exemplary embodiment.

Referring now to FIG. 8, a block diagram illustrating the online operation of pressure setpoint calculator 58 and pressure controller 57 is shown, according to an exemplary embodiment. Pressure setpoint calculator 58 may receive a measurement of $T_{GCC,out}$ from temperature sensor 33 and may use function 136 to calculate the corresponding pressure setpoint that achieves the optimal COP at that temperature. Pressure setpoint calculator 58 may then provide the pressure setpoint as an input to pressure controller 57. Pressure controller 57 may receive a measurement of the actual pressure $P_{GCC,out}$ of the $CO_2$ refrigerant at the outlet of gas cooler/condenser 2 from pressure sensor 34. Pressure controller 57 may operate high pressure valve 4 to drive the actual pressure P GCC,out toward the pressure setpoint using a feedback control process (e.g., PI control, PID control, etc.).

Configuration of Exemplary Embodiments

The construction and arrangement of the $CO_2$ refrigeration system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A refrigeration system comprising:

a plurality of evaporators within which a refrigerant absorbs heat, the plurality of evaporators comprising at least one first evaporator operating at a first evaporator state, and at least one second evaporator operating at a second evaporator state different than the first evaporator state;

a gas cooler/condenser within which the refrigerant rejects heat;

a plurality of compressors operable to circulate the refrigerant between the plurality of evaporators and the gas cooler/condenser, the plurality of compressors comprising at least one first compressor operating at a first compressor state, and at least one second compressor in series with the at least one first compressor, the at least one second compressor operating at a second compressor state different than first compressor state;

a high pressure valve operable to control a pressure of the refrigerant at an outlet of the gas cooler/condenser; and a controller configured to:

automatically generate a setpoint for a variable of the refrigeration system based on a measured temperature of the refrigerant at the outlet of the gas cooler/condenser, the variable comprising a coefficient of performance (COP) of the refrigeration system, the setpoint generated using a stored relationship between the measured temperature and a maximum estimated COP that can be achieved at the measured temperature;

calculate the COP of the refrigeration system during online operation of the refrigeration system as a function of a change in enthalpy of the refrigerant between the first evaporator state and the second evaporator state and a change in enthalpy of the refrigerant between the first compressor state and the second compressor state; and operate the high pressure valve to drive the variable toward the setpoint.

2. The refrigeration system of claim 1, wherein the setpoint is a COP setpoint.

3. The refrigeration system of claim 1, wherein the controller is configured to calculate the change in enthalpy of the refrigerant across at least one of the first or second evaporators and the change in enthalpy of the refrigerant across at least one of the first or second compressors based on measurements of the refrigerant obtained during the online operation of the refrigeration system.

4. The refrigeration system of claim 1, wherein the function of the change in enthalpy of the refrigerant across the at least one of the first or second evaporators is an average of the change in enthalpy of the refrigerant across the first and second evaporators, and the change in enthalpy of the refrigerant across the at least one first or second compressors is an average of the change in enthalpy of the refrigerant across the first and second compressors.

5. The refrigeration system of claim 1, wherein the function of the change in enthalpy of the refrigerant across the at least one of the first or second evaporators is a summation of the change in enthalpy of the refrigerant across the first and second evaporators and the change in enthalpy of the refrigerant across the at least one of the first or second compressors is a summation of the change in enthalpy of the refrigerant across the first and second compressors.

6. The refrigeration system of claim 1, wherein one of the first or second states is a subcritical state, and the other of the first or second states is a transcritical state.

7. The refrigeration system of claim 1, wherein the stored relationship between the measured temperature and the maximum estimated COP that can be achieved defines the maximum estimated COP that can be achieved as a direct function of the measured temperature.

8. The refrigeration system of claim 7, wherein the controller is configured to:

determine the maximum estimated COP that can be achieved at each of a plurality of values of the measured temperature, each value of the measured temperature and a corresponding value of the maximum estimated COP forming a two-dimensional data point; and perform a regression process to generate the direct function using the two-dimensional data points.

9. The refrigeration system of claim 1, wherein the stored relationship between the measured temperature and the maximum estimated COP that can be achieved defines a pressure of the refrigerant at which the maximum estimated COP can be achieved as a direct function of the measured temperature.

10. The refrigeration system of claim 9, wherein the controller is configured to:

use the stored relationship to determine the pressure of the refrigerant at which the maximum estimated COP can be achieved as a direct function of the measured temperature; and set a pressure setpoint to be equal to the pressure of the refrigerant at which the maximum estimated COP can be achieved.

11. The refrigeration system of claim 9, wherein the controller is configured to generate the stored relationship by:

determining, for each of a plurality of values of the measured temperature, a calculated COP of the refrigeration system at each of a plurality of values of a pressure of the refrigerant at the outlet of the gas cooler/condenser;

identifying, for each of the plurality of values of the measured temperature, a maximum of the calculated COP values and a corresponding value of the pressure of the refrigerant at which the maximum of the calculated COP values is achieved, each value of the measured temperature and the corresponding value of the pressure of the refrigerant forming a two-dimensional data point; and performing a regression process using the two-dimensional data points to generate a function that defines the pressure of the refrigerant at which the maximum estimated COP is achieved as a direct function of the measured temperature.

12. A method for controlling a refrigeration system, the method comprising:

operating a plurality of compressors in series, the plurality of compressors comprising at least one first compressor operating at a first compressor state and at least one second compressor in series with the at least one first compressor, the at least one second compressor operating at a second compressor state different than first compressor state to circulate a refrigerant between a plurality of evaporators, the plurality of evaporators comprising at least one first evaporator operating at a first evaporator state and at least one second evaporator operating at a second evaporator state different than the first evaporator state, the plurality of evaporators within which the refrigerant absorbs heat and a gas cooler/condenser within which the refrigerant rejects heat;

automatically generating a setpoint for a variable of the refrigeration system based on a measured temperature of the refrigerant at an outlet of the gas cooler/condenser, the variable comprising a coefficient of performance (COP) of the refrigeration system, the setpoint generated using a stored relationship between the measured temperature and a maximum estimated COP that can be achieved at the measured temperature;

calculating the COP of the refrigeration system during online operation of the refrigeration system as a function of a change in enthalpy of the refrigerant between the first evaporator state and the second evaporator state and a change in enthalpy of the refrigerant between the first compressor state and the second compressor state; and operating a high pressure valve positioned to control a pressure of the refrigerant at the outlet of the gas cooler/condenser to drive the variable toward the setpoint.

13. The method of claim 12, wherein the setpoint is a COP setpoint.

14. The method of claim 12, further comprising calculating the change in enthalpy of the refrigerant across at least one of the first or second evaporators and the change in enthalpy of the refrigerant across at least one of the first or second compressors based on measurements of the refrigerant obtained during the online operation of the refrigeration system.

15. The method of claim 12, wherein the function of the change in enthalpy of the refrigerant across the at least one of the first or second evaporators is an average of the change in enthalpy of the refrigerant across the first and second evaporators, and the change in enthalpy of the refrigerant across the at least one first or second compressors is an average of the change in enthalpy of the refrigerant across the first and second compressors.

16. The method of claim 12, wherein the function of the change in enthalpy of the refrigerant across the at least one of the first or second evaporators is a summation of the change in enthalpy of the refrigerant across the first and second evaporators and the change in enthalpy of the refrigerant across the at least one of the first or second compressors is a summation of the change in enthalpy of the refrigerant across the first and second compressors.

17. The method of claim 12, wherein the stored relationship between the measured temperature and the maximum estimated COP that can be achieved defines the maximum estimated COP that can be achieved as a direct function of the measured temperature.

18. The method of claim 17, further comprising:

determining the maximum estimated COP that can be achieved at each of a plurality of values of the measured temperature, each value of the measured temperature and a corresponding value of the maximum estimated COP forming a two-dimensional data point; and performing a regression process to generate the direct function using the two-dimensional data points.

19. The method of claim 12, wherein the stored relationship between the measured temperature and the maximum estimated COP that can be achieved defines a pressure of the refrigerant at which the maximum estimated COP can be achieved as a direct function of the measured temperature.

20. The method of claim 19, further comprising:

using the stored relationship to determine the pressure of the refrigerant at which the maximum estimated COP can be achieved as a direct function of the measured temperature; and setting a pressure setpoint to be equal to the pressure of the refrigerant at which the maximum estimated COP can be achieved.

21. The method of claim 19, further comprising generating the stored relationship by:

determining, for each of a plurality of values of the measured temperature, a calculated COP of the refrigeration system at each of a plurality of values of a pressure of the refrigerant at the outlet of the gas cooler/condenser;

identifying, for each of the plurality of values of the measured temperature, a maximum of the calculated COP values and a corresponding value of the pressure of the refrigerant at which the maximum of the calculated COP values is achieved, each value of the measured temperature and the corresponding value of the pressure of the refrigerant forming a two-dimensional data point; and performing a regression process using the two-dimensional data points to generate a function that defines the pressure of the refrigerant at which the maximum estimated COP is achieved as a direct function of the measured temperature.

* * * * *